United States Patent [19]

Woll et al.

[11] Patent Number: 4,864,670

[45] Date of Patent: Sep. 12, 1989

[54] WATER MATTRESS WITH VERTICALLY ORIENTED HYDRAULIC CHAMBERS

[75] Inventors: William J. Woll, Corona; Craig S. Miller, Anaheim Hills, both of Calif.

[73] Assignee: American National Watermattress Corporation, Anaheim, Calif.

[21] Appl. No.: 196,126

[22] Filed: May 19, 1988

[51] Int. Cl.[4] ..... A47C 27/08

[52] U.S. Cl. ..... 5/450; 5/451

[58] Field of Search ..... 5/451, 450, 452, 455, 5/457, 458, 422, 441

[56] References Cited

U.S. PATENT DOCUMENTS

| | | | |
|---|---|---|---|
| 4,329,748 | 5/1982 | Finkelstein | 5/451 |
| 4,577,356 | 3/1986 | Johenning et al. | 5/450 |
| 4,751,756 | 6/1988 | Monzo | 5/450 |

*Primary Examiner*—Alexander Grosz
*Attorney, Agent, or Firm*—Richard L. Myers

[57] ABSTRACT

A watermattress includes a outer bladder for retaining water and an inner chamber assembly for inhibiting wave motion within the bladder. The chamber assembly includes a first chamber disposed generally vertically with respect to a second chamber. The walls of the respective chambers form a passage which permits a flow of water from the first chamber to the second chamber thereby providing the chambers with different collapsed characteristics. The top chamber may have relatively fast collapse characteristic providing a soft sitting surface while the second chamber can have relatively slow collapse characteristics to more significantly retard the downward movement of a person sitting on the mattress.

17 Claims, 2 Drawing Sheets

WATER MATTRESS WITH VERTICALLY ORIENTED HYDRAULIC CHAMBERS

BACKGROUND

1. Field of the Invention

This invention relates generally to waterbed mattresses and more specifically to that type of mattress having interior hydraulic chambers for inhibiting wave motion and for providing a controlled release of water contents.

2. Discussion of the Prior Art

Water mattresses of the past have been adapted to two general types of waterbed assemblies. In one type of assembly, upstanding hardwood side panels support the mattress which is provided with generally square corners. In another type of construction, the waterbed is provided with foam panels, commonly referred to as softwides, which extend around the perimeter of the mattress. This latter type of construction and is commonly referred to as hybrid waterbed.

Each of these types of mattresses has been constructed with an outer bladder which is adapted to contain the water. Disposed within that bladder is a hydraulic chamber assembly having multiple chambers each adapted to inhibit wave motion and to provide a controlled release of the water in the chamber. Typical of this type of construction is the water mattress disclosed in U.S. Pat. No. 4,751,756 issued to George Monzo on June 21, 1988 and entitled WATER MATTRESS WITH HYDRAULIC CHAMBER ASSEMBLY AND METHOD OF MAKING SAME.

The chambers of the past have been disposed in juxtaposition, that is, with their side walls positioned next to each other. They have been constructed generally with their top surface near the top of the bladder and the bottom surface near the bottom of the bladder. Floating foam panels have been provided in the chambers near this upper surface, and sinking weight members have been disposed near the lower surface. This has facilitated the expansion of the chambers thereby encouraging the water to enter the chambers. Holes have been provided in the walls of the chambers in both the top surface and the bottom surface in order to accommodate a flow of the water between the chambers and the bladder. Such a flow occurs when a person sits or lies on the bed and the weight of the person tends to collapse the chamber. Under these conditions the water in the chambers will gradually flow through these holes into the bladder cavity.

With this construction the chambers have tended to collapse at a uniform rate until the person is ultimately in contact with the hard wooden base which supports the bladder. From this position it is very difficult for a person to arise from the bed, as he is seated at a level typically eight inches beneath the height of the side rail. His knees are elevated to the top of the side rails and his feet are generally off of the floor.

SUMMARY OF THE INVENTION

In accordance with the present invention, a hydraulic chamber assembly is provided with individual chambers that are disposed vertically with respect to each other. For example in one embodiment an upper chamber is disposed with its bottom surface in contact with the top surface of a lower chamber. These chambers are then provided with different numbers, sizes, and positions of holes which make their collapsing characteristics differ.

In a preferred construction the upper chamber is provided with a greater number and/or size of exit holes so that it collapses at a faster rate than the lower chamber. Under these circumstances, a person sitting on the bed would experience a gradual collapse of the upper chamber, as the water exits that chamber. If a hole is provided between the top and bottom chambers, the bottom chamber will tend to fill as the top chamber collapses. With these characteristics, the person sitting on the bed will ultimately contact the bottom chamber where he will experience a greater resistance to further downward travel. Thus, the person initially experiences a soft and accommodating surface, characterized by the rapid collapse of the top chamber, but eventually experiences a harder more resistant, surface characterized by the slower collapse of the lower chamber.

These and other features and advantages associated with this concept will be more apparent to those skilled in the art with a description of preferred embodiments of the invention and reference to the associated drawings.

DESCRIPTION OF PREFERRED EMBODIMENTS

Figure 1:
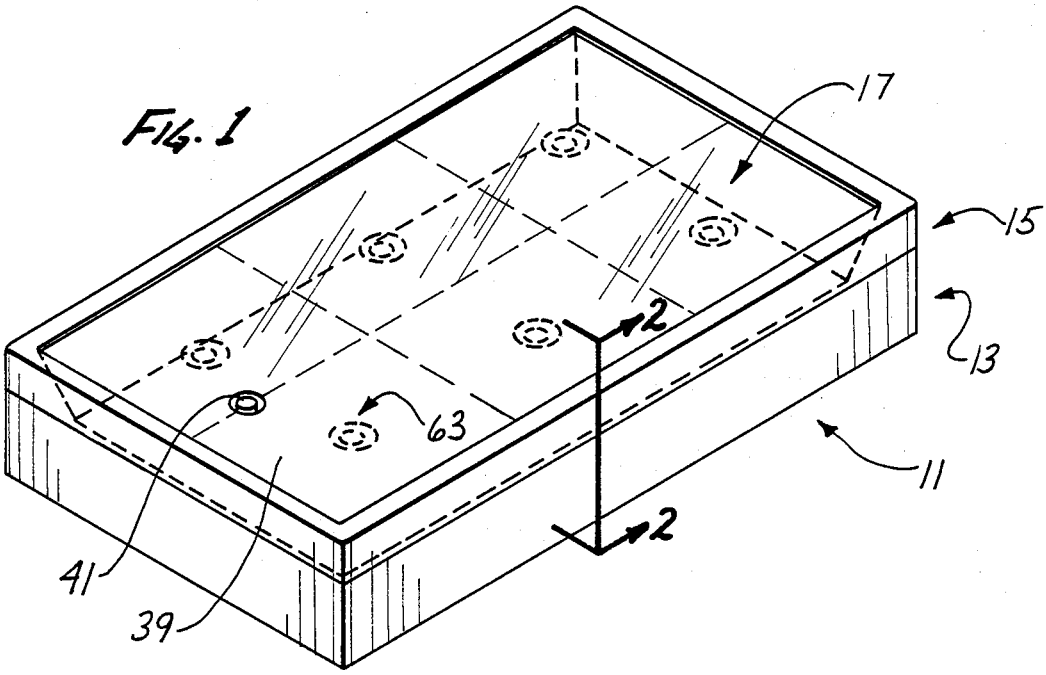
FIG. 1 is a perspective view of a waterbed of the hybrid type.
Figure 2:
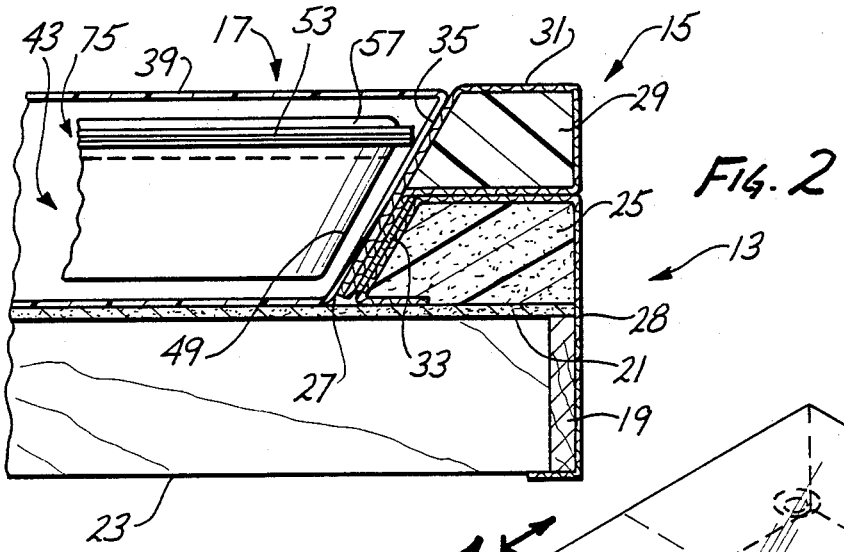
FIG. 2 is a cross section view taken along lines 2—2 of FIG. 1 and illustrating the slant sides associated with the outer bladder and inner chamber assembly of the mattress.

A waterbed is illustrated in FIG. 1 and designated generally by the reference numeral 11. This waterbed 11 is of the hybrid type having a pedestal 13 and foam side panels 15 which are configured to receive a waterbed mattress 17. With reference to FIG. 2, it will be noted that the pedestal 13 can be formed from upstanding wood side supports 19 which are capped with a planar base support 21, such as pressed wood, and covered along the bottom with a fabric, such as a dust cover 23.

The foam side panels 15 include a foam riser 25 disposed on top of the base support 21. This riser 25, which is provided with a slanted interior surface 27, can be covered with border quilting 28 which extends down the riser 25 and along the side of the pedestal 13.

Also included in the side panels 15 is a foam bolster 29 which can be covered with a polytwill backing 31 beginning and ending along the slant surface 27 of the riser 25. This backing can be attached along the surface 27 using an extended length of hook and loop material such as that commonly referred to by the tradmark Velcro 45.

The outer surface of the foam bolster 29 is coplanar with the sides of the riser 25 and the pedestal 13. An inner surface 35 of the bolster 29 is coplanar with the slant surface 27 of the riser 25. With this configuration, the support panel 21 and the slant surfaces 27 and 35 associated with the side panels 15, define a generally horizontal cavity for receiving the waterbed mattress 17.

Figure 3:
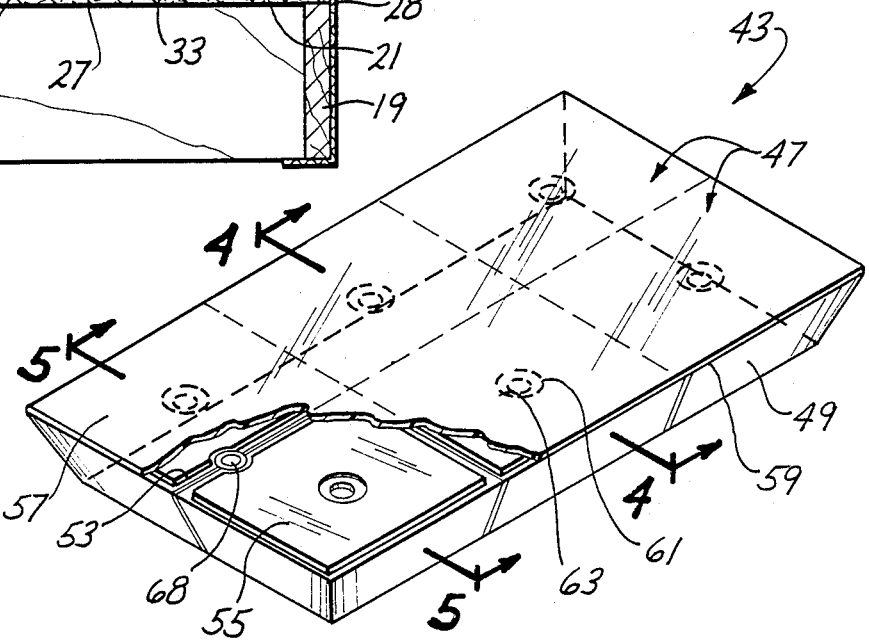
FIG. 3 is a perspective view, partially in section, of the chamber assembly associated with one embodiment of the present invention.

Referring to FIGS. 1 and 2, a preferred embodiment of the mattress 17 is illustrated to include an outer bladder 39 which is formed of plastic sheet material which defines a container impervious to water. A fill tube 41 provides access to the bladder 39 and permits the filling and withdrawal of water. Disposed within the bladder 39 is a hydraulic chamber assembly 43 which is further illustrated in the prospective view of FIG. 3.

The chamber assembly 43 is comprised generally of a plurality of individual chambers 47 which are disposed in juxtaposition to each other. In the illustrated embodiment, which has six chambers 47, a base sheet 49 formed from a single piece of material provides both the bottom and side walls of each chamber 47. A closure sheet 53 forms a common top wall for each of the chambers 47. Individual polyethylene foam panels 55 are disposed above the closure sheet 53 and are provided with an area slightly smaller than the cross sectional area of the chamber 47.

Finally, a top sheet 57 is provided to overlie the foam panels 55 and the closure sheet 53. This top sheet 57 is heat sealed to the closure sheet 53 and the base sheet 49 along a single seam which extends between the adjacent foam panels 55 and around the perimeter of the assembly 43. This single seam is designated in FIG. 3 by the reference numeral 59. It will be noted that in this embodiment only three pieces of material are combined in the single seam 59 which separates the adjacent chambers 47. In order to accommodate a flow of water into and out of the assembly 43, it is desirable to provide access from the bladder 39 into each of the chambers 47. For this reason, in the illustrated embodiment, a circular heat seal 61 joins the top sheet 57 and the closure sheet 53 and defines a top hole 63 which extends into the chamber 47. In order to provide a sufficient amount of material at the seal 59 around the top hole 63, it may be desirable to add a patch 65 of material between the closure sheet 53 and the top sheet 57. In addition to the top hole 63, a bottom hole 67 can be formed in the base sheet 49 to similarly provide access between the bladder 39 and the chamber 47.

Figure 5:
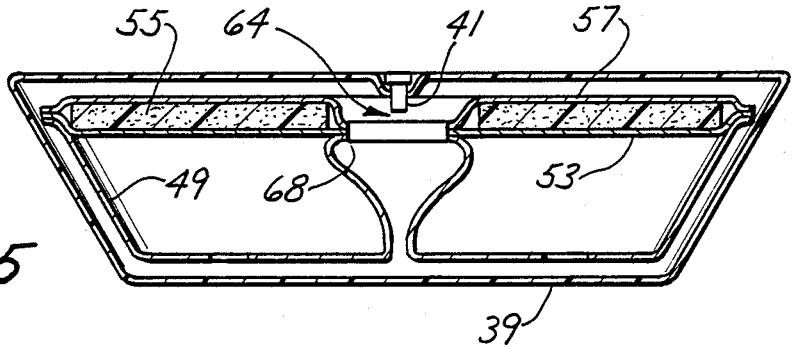
FIG. 5 is a cross sectional view of the chamber assembly taken along lines 5—5 of FIG. 3.

Referring now to FIG. 5, it will be noted that the chamber assembly 43 can be constructed so that a large void, shown generally at 64, is formed in proximity to the fill tube 41 of the bladder 39. This void will insure that the chamber assembly 43 does not block the fill tube 41 as water is being removed from the mattress 17. In a preferred embodiment, a circular heat seal joins the base sheet 49, the closure sheet 53 and the top sheet 57 in proximity to the fill tube 41. The resulting seal, which is designated by the reference numeral 68, can be provided with a diameter such as five inches.

The pocket containing the foam panel 55 is preferably isolated from the water in the bladder 39 and the chambers 47. This isolation is provided not only by the seam 59 but also by the seal 61 which joins the top sheet 57 and the closure sheet 53 through an enlarged opening in the foam panel 55. Forming the seal 61 through the opening has been particularly advantageous in keeping the foam panel from bunching or otherwise folding back on itself.

With the chamber assembly 43 disposed in the water filled bladder 39, the foam panels 55 in their respective air pockets tend to cause the upper surface of the bladder assembly 43 to float. If the base sheet 49 of the assembly 43 is made of a polyethylene, its specific gravity which is greater than unity, will cause the bottom of the chamber assembly 43 to sink in the bladder 39. Thus, opposite top and bottom walls of the assembly 43 will tend to separate in the water. As this occurs, the water in the bladder 39 enters the holes 63 and 67 to occupy the volume of the chambers 47.

When an individual sits or lies on the waterbed 11, his weight will squeeze the chambers 47 and the water in the chambers will tend to exit through the holes 63 and 67. Depending upon the size of these holes, the time required to deflate the chamber 47 can be controlled. This of course affects the "hardness" of the mattress 17.

Also, since the chambers 47 function independently, a person sitting or lying on one area of the mattress 17 will not substantially affect the comfort of an individual sitting or resting on another portion of the mattress 17. Of course the chamber assembly 43, by nature of its presence within the bladder 39, will naturally inhibit any wave motion which may occur within the bladder 39.

Figure 4:
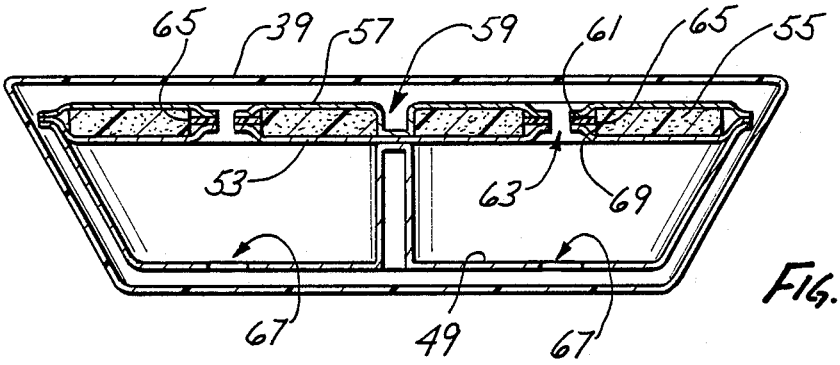
FIG. 4 is a cross sectional view of the chamber assembly taken along lines 4—4 of FIG. 3.
Figure 6:
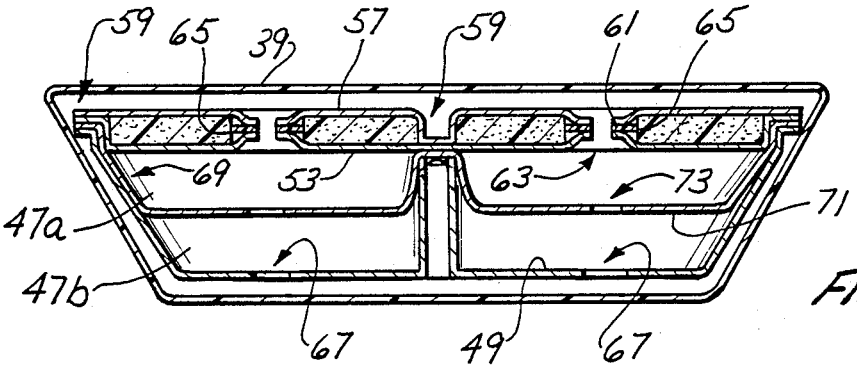
FIG. 6 is a cross sectional view similar to FIG. 4 and illustrating the concept of the present invention.

Of particular interest to the present invention is the embodiment best illustrated in FIG. 6 which is a cross sectional view similar to FIG. 4. All of the foregoing characteristics of the assembly 43 apply to this embodiment except that a central panel 71 is provided and extends generally horizontally across each of the chambers 47 between the closure sheet 53 and the base sheet 49. This central sheet 71 divides each of the chambers 47 into an upper chamber **47*a* and a lower chamber 47*b*. It can be seen that with this embodiment, the number of is doubled with the single central sheet 71. Thus instead six chamber embodiment illustrated in FIG. 4, this particular embodiment provides twelve chambers. More importantly however, the chambers 47*a* and 47*b* are disposed generally vertically with respect to each other. That is, at least a portion of the upper chamber 47*a* overlies a portion of the lower chamber 47*b*. With this configuration, the lower chamber 47*b* is disposed generally beneath the upper chamber 47*a***.

In the illustrated embodiment, the top hole 63 provides a passage between the upper chamber **47*a* and the bladder 39. The bottom hole 67 provides a passage between the lower chamber 47*b* and the bladder 39. These holes 63 and 67 primarily function as exit holes through which water within the respective chambers 47*a* and 47*b* can exit to the bladder 39** as they collapse.

Peculiar to this particular embodiment is a central hole 73 which is formed in the central sheet 71 and provides a passage between the upper chamber **47*a* and the lower chamber 47*b*. Although not fully understood, it is believed that this central hole 73 performs a dual function in this embodiment of the mattress 17. Thus the central hole 17 functions as an exit hole with respect to the upper chamber 47*a* but also functions as an entrance hole with respect to the lower chamber 47*b***.

At that critical time when a person initially sits upon the mattress 17, the primary pressure is exerted on the upper chamber **47*a* and tends to force the water in that chamber through the top hole 63 and central hole 73. As this upper chamber 47*a* gradually collapses, the lower chamber 47*b* remains relatively full. Even though some of its water may be exiting the bottom hole 67, much of that water appears to be replaced by the flow though the central hole 73 into the lower chamber 47***b*. Thus when the weight of the person fully collapses the upper chamber 47*a*, the lower chamber 47*b* is still substantially full and provides noticeable resistance to the further downward travel of the person.

Since the rate of collapse of the upper chamber 47*a* can be controlled by varying the size of the top hole 63 and the central hole 73, and since the rate of collapse of the lower chamber 47*b* can be controlled by varying the size of the central hole 73 and the bottom hole 67, this embodiment of the mattress 17 can be provided with different collapsed characteristics for the individual chambers 47*a* and 47*b*. In a preferred embodiment, the upper chamber 47*a* is constructed to collapse at a faster rate than the lower chamber 47*b*.

From a comfort standpoint, a person initially sitting on the bed would experience the relatively soft and accommodating rapid collapse of the upper chamber 47*a*. Over time, as this chamber 47*a* fully collapses, the individual would experience a harder supporting surface resulting from the slower collapse of the lower chamber 47*b*. This of course is desirable as the intent is to slow the of the lower chamber 47*b* and thereby delay that point in time when the person finally contacts the rigid planar base support 21.

In the preferred embodiment, the central sheet 71 is gathered into the single seam 59 along with the top sheet 57, closure sheet 53, and base sheet 49. Thus, this seam 59 functions to separate each horizontally oriented pair of upper chambers 47*a* and each horizontally oriented pair of lower chambers 47*b*. In the illustrated embodiment, the base sheet 49 is vacuum formed so that it provides the bottom panel and the side panels for the lower chamber 47*b*. The central sheet 71 can also be vacuum formed so that it provides the bottom panel and the side panels for the upper chamber 47*a*. In this embodiment the central sheet 71 also provides the top panel for the lower chamber 47*b* while the closure sheet 53 provides the top panel for the upper chamber 47*a*.

In the embodiment of Figure 6, all of these sheets 53, 57, 49 and 71 are brought together in the single seal which forms the seam 59. Since the seam 59 is disposed generally in the plane of the closure sheet 53, it follows that the side panels of the lower chamber 47*b* extend in juxtaposition to the side panels of the upper chamber 47*a* as illustrated at 69 in FIG. 6. In this particular embodiment, the upper chamber 47*a* appears to be disposed within the lower chamber 47*b*.

In the illustrated embodiment, the top hole 63, central hole 73 and bottom hole 67 have generally the same diameter, such as one and one- half inches. It might seem from this construction that both the upper chamber 47*a* and lower chamber 47*b* would have the same collapsing characteristics. However, this does not appear to be the case, because the top hole 63 and the central hole 73 both function as exit holes for the upper chamber 47*a*, while only the bottom hole 67 functions as an exit hole for the lower chamber 47*b*. In addition, the central hole 73 functions as a fill hole for the lower chamber 47*b* at least while the upper chamber 47*a* is collapsing.

Figure 7:
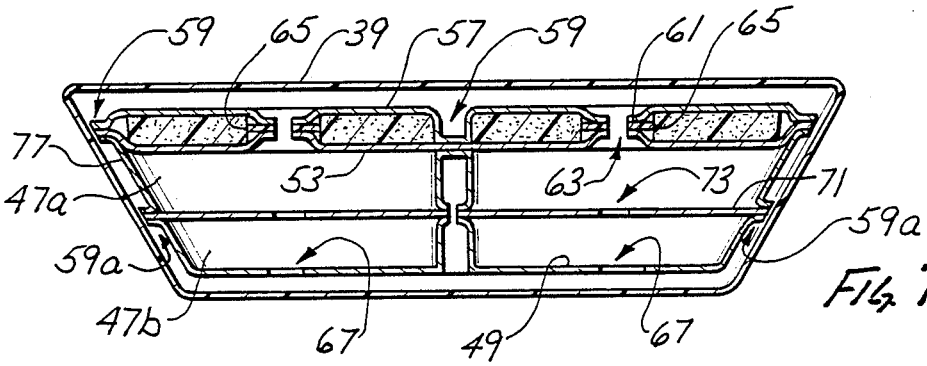
FIG. 7 is a cross sectional view similar to FIG. 6 and illustrating a further embodiment of the present invention.

FIG. 7 illustrates an embodiment similar to that of FIG. 6 except the vertically oriented chambers 47*a* and 47*b* are formed by separate main seams, 59 and 59*a* respectively. Each of the seams 59 and 59*a* are formed from only three sheets of material.

In this embodiment, a separate side sheet 77 is provided to form the side panel for the upper chamber 47*a*. This sheet 77 is brought together with the top sheet 57 and the closure sheet 53 to form the seam 59. The side sheet 77 also contributes to formation of the second seam 59*a* along with the central sheet 71 and the bottom sheet 49.

With this configuration, the number of sheets forming each of the seams 59 and 59*a* is limited to three. Also, in comparison with the embodiment of FIG. 6, it will be noted that the side panel defining the upper chamber 47*a* does not extend in juxtaposition to the side panel defining the lower chamber 47*b*. This embodiment of FIG. 7 further exemplifies the concept of the present invention whereby the chambers are vertically oriented, with the lower chamber 47*b* disposed beneath the upper chamber 47*a*.

Although this concept has been disclosed with respect to a particular embodiments, it will be obvious to those skilled in the art that the concept can be otherwise embodied. For example, the top hole 63, the central hole 73, and the bottom hole 67 can be vertically aligned as illustrated. On the other hand, these holes can be offset so that the water exiting the upper and lower chambers 47*a* and 47*b* respectively, will follow a more torturous path.

Do to the fact that there are many embodiments which can be characterized within the concept of this watermattress, the scope of the invention should be ascertained only with reference to the following claims.

We claim:

1. A watermattress comprising:

a bladder formed from a material impervious to water;

means included in the bladder to facilitate filling the bladder with water;

a chamber assembly disposed within the bladder for controlling the rate of collapse of the watermattress in response to a person sitting or lying on the watermattress;

a first sheet of impervious material included in the chamber assembly;

a second sheet of impervious material included in the chamber assembly and forming with the first sheet a sealed cavity;

foam means disposed in the sealed cavity for enhancing the flotation characteristics of the cavity within the water of the bladder;

a third sheet of impervious material included in the chamber assembly and forming with the second sheet a first chamber;

a fourth sheet of impervious material included in the chamber assembly and forming with the third sheet a second chamber disposed generally vertically relative to the first chamber within the bladder;

portions of the second sheet defining a first hole to permit a flow of the water between the first chamber and the bladder;

portions of the fourth sheet defining a second hole to permit a flow of the water between the second chamber and the bladder; and portions of the third sheet defining a third hole to permit a flow of the water between the first chamber and the second chamber.

2. The watermattress recited in claim 1 further comprising:

means for combining the first sheet, the second sheet, the third sheet, and the fourth sheet of the chamber assembly to form a seal around the perimeter of the chamber assembly.

3. The watermattress recited in claim 2 wherein the seal comprises a first seal and the first chamber forms with the second chamber one of a plurality of chamber pairs disposed laterally of each other in the chamber assembly, and the watermattress further comprises:

means for combining the first sheet, the second sheet, the third sheet, and the fourth sheet of the chamber assembly to form a second seal between adjacent chamber pairs of the chamber assembly.

4. The watermattress defined in claim 3 wherein the second seal is formed along a line which is generally straight in configuration and extends between two different points on the first seal.

5. The watermattress recited in claim 1 wherein:

the rate of flow of the water exiting the first chamber in response to a person sitting or lying on the watermattress is dependent upon the size of the first hole;

the rate of flow of the water exiting the second chamber in response to the person sitting or lying on the watermattress is dependent upon the size of the second hole; and the rate of flow of the water from the first chamber is greater than the rate of flow of water from the second chamber in response to the person sitting or lying on the watermattress.

6. A watermattress comprising:

a bladder formed from a material impervious to water;

means providing access to the bladder for filling the bladder with water;

a chamber assembly disposed within the bladder for controlling the collapse of the bladder beneath a person sitting or lying on the watermattress;

a first wall forming a first chamber of the chamber assembly, and portions of the first wall defining a plurality of first holes each providing a passage between the first chamber and the bladder;

a second wall forming a second chamber of the chamber assembly, and portions of the second wall defining a plurality of second holes each providing a passage between the second chamber and the bladder;

the second chamber being disposed generally beneath the first chamber;

the first holes being collectively larger in size than the second holes so that the first chamber tends to collapse at a faster rate than the second chamber in response to the person sitting or lying on the watermattress; whereby the person initially experiences a relatively softer supporting surface in response to the rapid collapse of the first chamber and ultimately experiences a relatively harder supporting surface in response to the slower collapse of the second chamber.

7. The watermattress recited in claim 6 further comprising:

buoyancy means attached to the first wall of the first chamber for elevating the first chamber relative to the second chamber of the chamber assembly.

8. The watermattress defined in claim 6 further comprising:

means combining the first wall of the first chamber and the second wall of the second chamber in a continuous seal; and the continuous seal extending around the perimeter of the chamber assembly.

9. The watermattress defined in claim 8 further comprising:

a top panel included in the first wall, the top panel being disposed at the top of the first chamber;

a bottom panel included in the second wall, the bottom panel being disposed at the bottom of the second chamber;

a central panel disposed between the top panel and the bottom panel, the central panel forming the first chamber with the top panel and forming the second chamber with the bottom panel; and the top panel, the central panel, and the bottom panel being combined in the continuous seal.

10. The watermattress recited in claim 9 wherein the top panel has a generally planer configuration and the continuous seal is disposed generally in the plane of the top panel.

11. The watermattress recited in claim 6 further comprising:

a top panel included in the first wall, the top panel being disposed at the top of the first chamber;

a side panel included in the first wall, the side panel being disposed at the side of the first chamber;

a bottom panel included in the second wall, the bottom panel being disposed at the bottom of the second chamber;

a central panel disposed between the top panel and the bottom panel, the central panel forming the first chamber with the top panel and the side panel, and forming the second chamber with the bottom panel;

the top panel and side panel being combined in a first continuous seam which extends around the periphery of the chamber assembly; and the side panel, central panel and bottom panel being combined in a second continuous seam which extends around the perimeter of the chamber assembly.

12. The watermattress defined in claim 11 wherein;

the top panel and the central panel each having a generally planar configuration;

the first continuous seam being disposed generally in the plane of the top panel; and the second continuous seam being disposed generally in the plane of the central panel.

13. The watermattress recited in claim 9 or claim 11 further comprising:

portions of the central panel defining at least one third hole providing a passage between the first chamber and the second chamber.

14. A watermattress comprising:

a bladder formed from a sheet material impervious to water;

means included in the bladder to facilitate filling the bladder with water;

a chamber assembly formed from a sheet material and disposed within the bladder for controlling the rate of collapse of the bladder beneath a person sitting or lying on the watermattress;

portions of the sheet material forming a first chamber in the chamber assembly and defining a first passage from the first chamber into the bladder, the first chamber having a first rate of collapse providing a controlled descent for the person sitting or lying on the watermattress;

portions of the sheet material forming a second chamber in the chamber assembly generally beneath the first chamber and defining a second passage from the second chamber into the bladder, the second chamber having a second rate of collapse providing a controlled descent for the person sitting or lying on the watermattress;

the first passage being larger than the second passage so that the water exits the first chamber at a faster rate than the second chamber;

the first rate of collapse of the first chamber being greater than the second rate of collapse of the second chamber; whereby the person sitting or lying on the watermattress initially descends more rapidly in response to the collapse of the first chamber and then descends more slowly in response to the collapse of the second chamber.

15. The watermattress recited in claim 14 further comprising:

buoyancy means attached to the top of the first chamber for elevating the first chamber relative to the second chamber within the bladder.

16. The watermattress recited in claim 14 further comprising:

a common wall disposed between the first chamber and the second chamber; and portions of the common wall defining at least one third passage between the first chamber and the second chamber.

17. The watermattress defined in claim 16 wherein the water exits the first chamber through the first passage into the bladder and exits the first chamber through the third passage into the second chamber in response to the person sitting or lying on the watermattress.

* * * * *